US006743636B2

(12) United States Patent
Chung et al.

(10) Patent No.: US 6,743,636 B2
(45) Date of Patent: Jun. 1, 2004

(54) MICROFLUID DRIVING DEVICE

(75) Inventors: Chen-Kuei Chung, Hsinchu (TW); Wei-Jieh Chang, Hsinchu (TW); Chieh-Ling Hsiao, Hsinchu (TW); Kuo-Yao Weng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 432 days.

(21) Appl. No.: 09/863,332

(22) Filed: May 24, 2001

(65) Prior Publication Data

US 2002/0176802 A1 Nov. 28, 2002

(51) Int. Cl.[7] ..... B01L 3/02

(52) U.S. Cl. ..... 436/100; 422/99; 422/103; 436/174; 436/180

(58) Field of Search ..... 422/103, 60.1, 422/99, 101, 102; 436/474, 179, 100; 204/450, 451, 453, 454

(56) References Cited

U.S. PATENT DOCUMENTS 5,997,518 A * 12/1999 Laibovitz et al. ..... 604/296
6,008,893 A * 12/1999 Roos et al. ..... 356/246
6,017,460 A * 1/2000 Eller et al. ..... 210/739
6,109,041 A * 8/2000 Mitchell et al. ..... 62/6
6,146,103 A * 11/2000 Lee et al. ..... 417/50
6,227,824 B1 * 5/2001 Stehr ..... 417/540
6,416,642 B1 * 7/2002 Alajoki et al. ..... 204/451
6,540,895 B1 * 4/2003 Spence et al. ..... 204/450
6,576,194 B1 * 6/2003 Holl et al. ..... 422/81
2003/0011845 A1 * 1/2003 Fritsch et al. ..... 417/48

* cited by examiner

*Primary Examiner*—Jill Warden
*Assistant Examiner*—Dwayne K Handy
(74) *Attorney, Agent, or Firm*—Bacon & Thomas, PLLC

(57) ABSTRACT

A microfluid driving device is provided. The microfluid driving device of this invention comprises microfluid driving platform prepared in a chip, which platform comprises at least two miniature Venturi pumps, at least one microchannel and optionally micro mixers or micro reactors in said microchannel; an external pneumatic flow supply and control module that provides selectively different air flows; and an interface device connecting said microfluid driving platform and said external pneumatic flow supply and control module. The air flows supplied by said the pneumatic flow supply and control module are supplied under selected flow rates and frequencies to said at least two Venturi pumps through said interface device, such that the microfluid inside said microchannel may be driven forward or backward or halt and the transportation, mixing and reaction of the microfluid may be accomplished.

4 Claims, 5 Drawing Sheets

| flow rate of supplied airflow | flow rate of test fluid* |
|---|---|
| 2.25 slpm | 0.78 mm/sec. |
| 2.40 slpm | 2.60 mm/sec. |
| 2.55 slpm | 5.39 mm/sec. |
| 2.75 slpm | 9.49 mm/sec. |

*Note:4.3 $\mu$l blue ink.

Fig. 5

MICROFLUID DRIVING DEVICE

FIELD OF INVENTION

The present invention relates to a microfluid driving device, especially to a non-contact pneumatic microfluid driving device comprising an external servo system and a chip carrying a microfluid driving platform.

BACKGROUND OF INVENTION

The "biochip" which is able to automatically operate the nucleic acid sample processing and the testing of base series has been developing in all countries the world. In these biochips, the microfluid driving system that drives microfluid that contains samples of biochemical agents to move inside microfluidic channels is one of the most important equipments. The question of how to easily control fluid movement and avoid the cross pollution of the sample or the biochemical agents with the driving system, as become a question of interest.

The microfluid driving system that are known to the public may be divided into three classes. They are the on-chip mechanical micropump, the on-chip electrokinetic micropump and the external servo system. Descriptions thereof will be given as follows:

On-Chip Mechanical Micropump

The on-chip mechanical micropump is an embedded mechanical micropump prepared directly in a chip with the micromachining technology. In an on-chip mechanical micropump, there must have moveable parts in the chip. The electrostatically driven diaphragm micropump invented by Roland Zyngerle et al., U.S. Pat. No. 5,529,456 is one example.

In such a micropump, the micropump includes a pressure chamber. An intermittent electrostatic driving force is generated between the two-layer structure of the pressure chamber and the two one-way passive check valves positioned in the microfluidic channel are driven in turns. Such an operation generates a pumping force to the microfluid. The working flow rate of the micropump is about 350 $\mu$l/min.

The micromachined peristaltic pump invented by Frnak T. Hartley, U.S. Pat. No. 5,705,018 disclosed to another structure. In this invention, a series of flexible conductive strips are provided along the inner wall of the microchannel which is provided in a chip. When voltage pulses pass over the microchannel, the flexible conductive strips are pulled upward by electrostatic force generated in turn. A peristaltic phenomena will thus take place. The microfluid in the microchannel may thus be driven by the driving force of the strips. Working flow rate of this invention is about 100 $\mu$l/min.

In such a mechanical microfluid driving system provided with moveable elements and with a complicated structure, it is very difficult to clean up all residuals of samples or biochemical reagents of another experiment. As a result, most microfluid driving systems for biochips shall be disposable. However, both the embedded rotational micropump and the embedded peristaltic micropump have complicated process of manufacture and expensive customer design components, which made the preparation costs of the micropump relatively high. Such a micropump is not suited in disposable chips.

In addition to that, the mechanical micropumps are generally prepared with membranes, valves or gears which are driven by relatively higher powers, such as electric, magnetic or thermal powers. Such a requirement involves complicated structure, complicated operations and higher costs. Furthermore, it is even more difficult to prepare a pump or pump module that provides driving forces back and forth in the microchannel.

On-Chip Electrokinetic Micropump

The on-chip electrokinetic micropump is a non-mechanical micropump. Inside the pump there are no moveable elements. Operations of such a micropump may be carried on by electro-osmosis (EO), electro-hydrodynamic (EHD) or electrophoresis (EP).

In 1997 Peter J. Zanzucchi et al. disclosed an apparatus and methods for controlling fluid flow in microchannels in their U.S. Pat. No. 5,632,876. This invention related to a microfluid driving system employing the combination of the electro-osmosis power and the electro-hydrodynamic power. The invented apparatus comprises a microchannel provided in a chip and two pairs of electrodes, totally four, are arranged in the microchannel in turn. A pair of electrodes are deeply put in the microchannel. When high voltage is applied to the electrodes, fluid adjacent to the electrodes will be carried in a direction reverse to the direction of the electrical current. An EHD pumping is thus accomplished. Electrodes of the other pair are positioned at both sides from the first pair and contact the walls of the microchannel. When a high voltage is applied to these electrodes, the walls of the microchannel are first electrically charged and charged carriers are accumulated. Electro-osmosis is thus generated in the charge-containing particles in the microfluid and drives the microfluid to flow, carrying out the so-called EO pumping. In this apparatus two kinds of electrode-generated powers are used to generate pumping forces to the microfluid. The microfluid may thus be driven forward, backward or halt inside the microchannel by controlling the ratio of the EHD pumping force and the EO pumping force.

Paul C. H. Li and D. Jed Harrison disclosed a microfluid driving system with the combination of the electro-osmosis power and the electrophoresis power in their article entitled "Transport, manipulation, and reaction of biological cells on-chip using electrokinetic effects (Anal. Chem. 1997, 69,m 1564–1568). In this driving system, electro-osmosis force generators and electrophoresis force generators are arranged in turn in the microchannel. The differences between an electro-osmosis force and an electrophoresis force adjacent to each other, cells in a microfluid may be easily driven to move, direction-turning or even classification. However, the objects moved by the electro-osmosis force or the electrophoresis force are the charge-containing particles in the solution, not the solution itself. As a result, these inventions are not driving systems for microfluids, but rather, are driving systems for charged cells, such as canine erythrocyte et al., in a solution.

From the process point of view, the electrode micropump is simple in structure, low in manufacture cost but limited in application. First, inside the microchannel, solvent must be filled before anything may be driven. It is not possible to introduce samples or reagents into empty channels. Secondly, the distance that an EHD pump can drive a microfluid is limited. The objects that an EO pump or an EP pump drives are charge-containing particles in a microfluid, not the microfluid itself. Neither of these pumps provides satisfactory pumping effects. Working flow rate of these pumps is about 10 $\mu$l/min. In addition, these pumps may only work in microchannels with tiny diameter, e.g., 100 μm and a voltage difference of hundreds to thousands of volt must be generated within a short distance. High operation costs are thus caused. The EHD pump can only be applied to non-polar organic solvents and the EO pump and the EP pump can only be applied polar solvents. The driving efficiency of the pumps is highly influenced by the concentration of ions in the solution. When the ion concentration of the solution varies during the reaction, driving of the solution will become more difficult to control.

External Servo System

When the microfluid is driven by an external servo system, there is no need to provide any active element in the chip containing the microchannel. Such a chip may be prepared under a lower cost easily. The external servo system is not directly connected to the samples or the reagents and maybe used repeatedly. The problem is the interface between the servo system and the chip, the "system-to-chip interface". How to connect transmission pipes of carrier fluids, which are in normal sizes, to the microchannels of the chip, which are miniature in size, will become a task to be achieved by using a series of micro fabrication technologies. If the problem of the system-to-chip interface can be solved, the combination of an external servo system and a disposable biochip which contains no active components will be highly feasible in the preparation of the microfluid driving system.

It is thus necessary to provide a novel microfluid driving device that provides driving forces to microfluid such that the microfluid may proceed inside a microchannel.

It is also necessary to provide a microfluid driving device that is simplified and is easy to prepare.

It is also necessary to provide a microfluid driving device with an external servo system to drive the bi-directional movement of microfluid in a microchannel.

OBJECTIVES OF INVENTION

The objective of this invention is to provide a novel microfluid driving device that provides driving forces to microfluid such that the microfluid may proceed inside a microchannel.

Another objective of this invention is to provide a microfluid driving device that is simplified and is easy to prepare.

Another objective of this invention is to provide a microfluid driving device with an external servo system to drive the bi-directional movement of microfluid in a microchannel.

Another objective of this invention is to provide a bi-directional driving method for microfluid.

Another objective of this invention is to provide a novel bi-directional driving system for microfluid.

SUMMARY OF INVENTION

According to this invention, a microfluid driving device is provided. The microfluid driving device of this invention comprises microfluid driving platform prepared in a chip, which platform comprises at least two miniature Venturi pumps, at least one microchannel and optionally micro mixers or micro reactors in said microchannel; an external pneumatic flow supply and control module that provides selectively different air flows; and an interface device connecting said microfluid driving platform and said external pneumatic flow supply and control module. The air flows supplied by said the pneumatic flow supply and control module are supplied under selected flow rates and frequencies to said at least two Venturi pumps through said interface device, such that the microfluid inside said microchannel may be driven forward or backward or halt and the transportation, mixing and reaction of the microfluid may be accomplished.

These and other objectives and advantages of this invention may be clearly understood from the detailed description by referring to the following drawings.

BRIEF DESCRIPTION OF DRAWINGS

FIG. 5 is a table showing the relation between the flow rates of the driving airflow and the flow rates of microfluid as driven.

DETAILED DESCRIPTION OF INVENTION

According to this invention, a microfluid driving device is provided. The microfluid driving device of this invention comprises microfluid driving platform prepared in a chip, which platform comprises at least two miniature Venturi pumps, at least one microchannel and optionally micro mixers or micro reactors in said microchannel; an external pneumatic flow supply and control module that provides selectively different air flows; and an interface device connecting said microfluid driving platform and said external pneumatic flow supply and control module. The air flows supplied by said the pneumatic flow supply and control module are supplied under selected flow rates and frequencies to said at least two Venturi pumps through said interface device, such that the microfluid inside said microchannel may be driven forward or backward or halt and the transportation, mixing and reaction of the microfluid may be accomplished.

Figure 1:
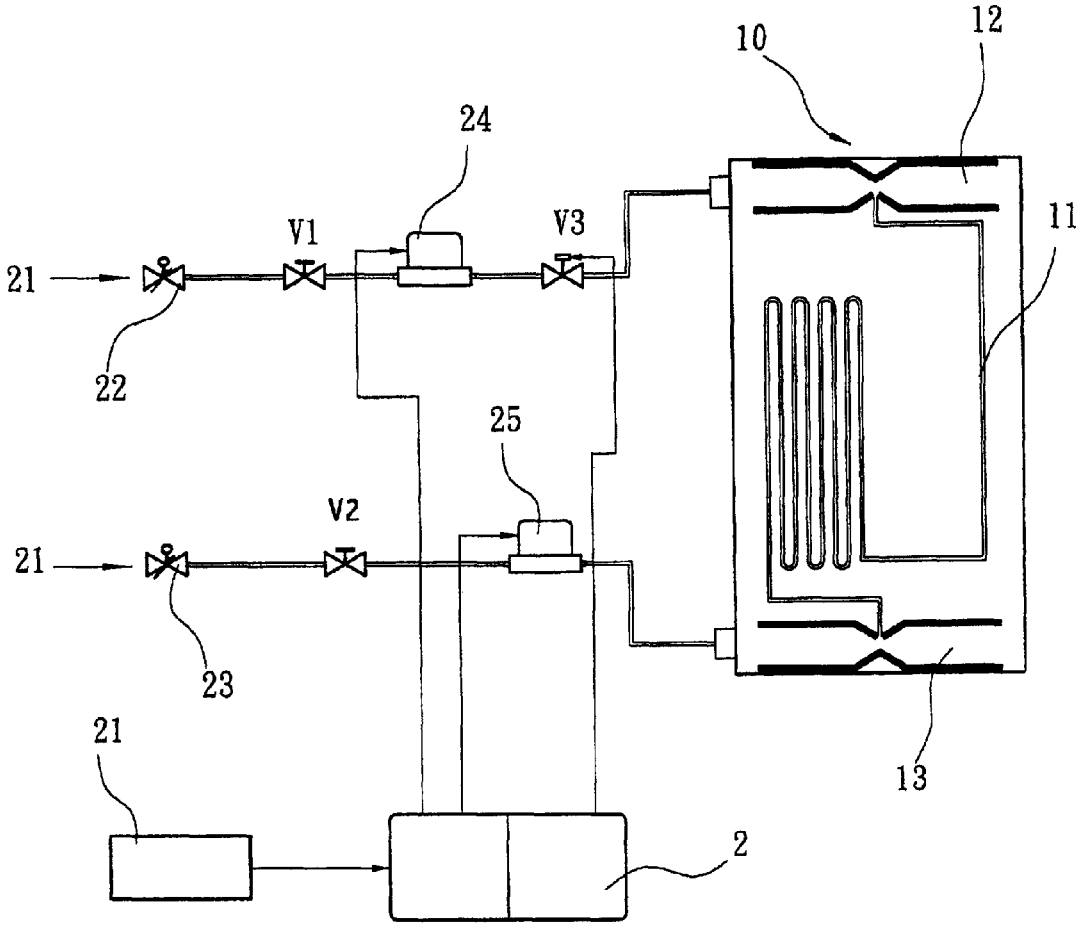
FIG. 1 illustrates the system diagram of one embodiment of the microfluid driving device of this invention.

The following is a detailed description of an embodiment of the microfluid driving device of this invention. FIG. 1 shows the planar diagram of an embodiment of the microfluid driving device of this invention. As shown in this figure, the microfluid driving device of this invention comprises a microfluid driving platform 10, a pneumatic flow supply and control module 20 and an interface device 30. The microfluid driving platform 10 comprises a microchannel 11, allowing a microfluid to flow through it, and two Venturi pumps 12, 13, each connected to one terminal of the microchannel 11.

The pneumatic flow supply and control module 20 comprises a pneumatic source 21 and airflow supplying pipes 22, 23, to supply airflows to the Venturi pumps 12, 13, respectively. In the airflow supplying pipes 22, 23, provided are flow rate controllers 24 and 25 respectively. A microcontroller (not shown) is used to control the flow rate controllers 24, 25, such that flow rates of airflows supplied to the Venturi pumps 12, 13 may be respectively and selectively controlled.

Figure 2:
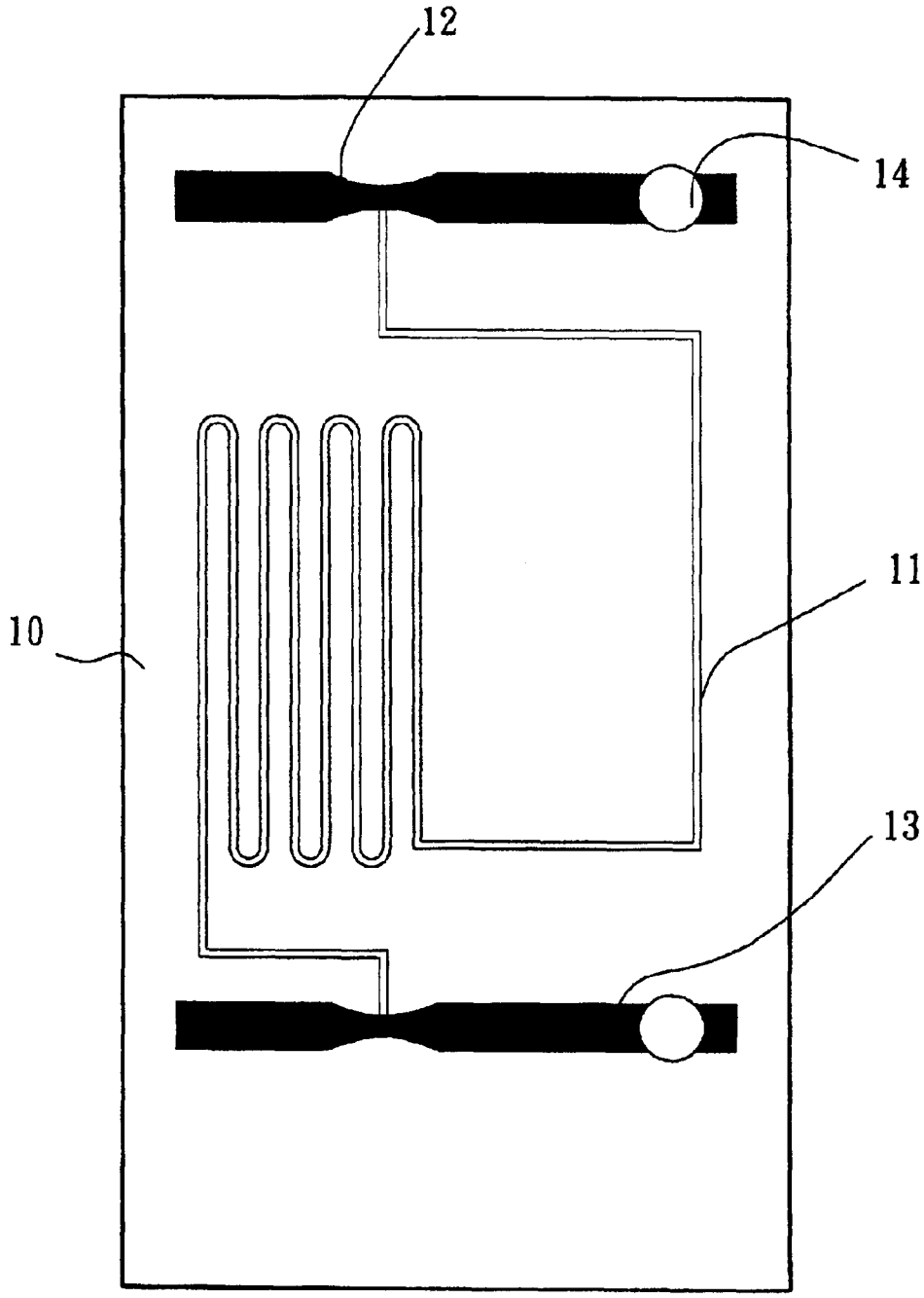
FIG. 2 shows the planar structure of a microfluid driving platform suited in the microfluid driving device of this invention.

Now refer to FIG. 2. FIG. 2 shows the planar structure of the microfluid driving platform 10. As shown in this figure, the Venturi pumps 12, 13 are respectively pneumatic channels with a narrow central portion and wider side portions. When the flow rate of an airflow flowing through a Venturi pumps 12 or 13 reaches a certain speed, a lower air pressure will be generated at the narrow portion which sucks the fluid inside the fluid channel 11 connected to the Venturi pump to move towards the Venturi pump. Such a phenomenon is called the "Bernoulli effect". Thus, when an airflow is supplied to the first Venturi pump 12 and no airflow is supplied to the second Venturi pump 13, the fluid inside the microchannel 11 is driven to move toward the first Venturi pump 12. And vice versa. When both Venturi pumps 12, 13 are supplied airflows in different flow rates, the fluid inside the microchannel 11 may move forward or backward or halt in the microchannel 11, under a controlled speed. When airflows are supplied to one Venturi pump and to another in turn, the fluid may be mixed in the microchannel 11.

A reactor, such as a heater, not shown, may be provided in the microchannel 11 to carry out desired reactions in the reactor.

In the microfluid driving platform 10 as described above, the control of the flow rate may be accomplished accurately, if the surface tension of the microfluid to the walls of the microchannel is taken for consideration. These factors are unique when the microchannel is in a miniature size.

In the microfluid driving platform 11, an inlet well 14 may be provided, whereby microfluid may be filled into the microchannel 11. When a fluid is filled to the inlet well 14 and an airflow is supplied to the second Venturi pump 13, the fluid may be sucked into the microchannel 11.

Figure 3:
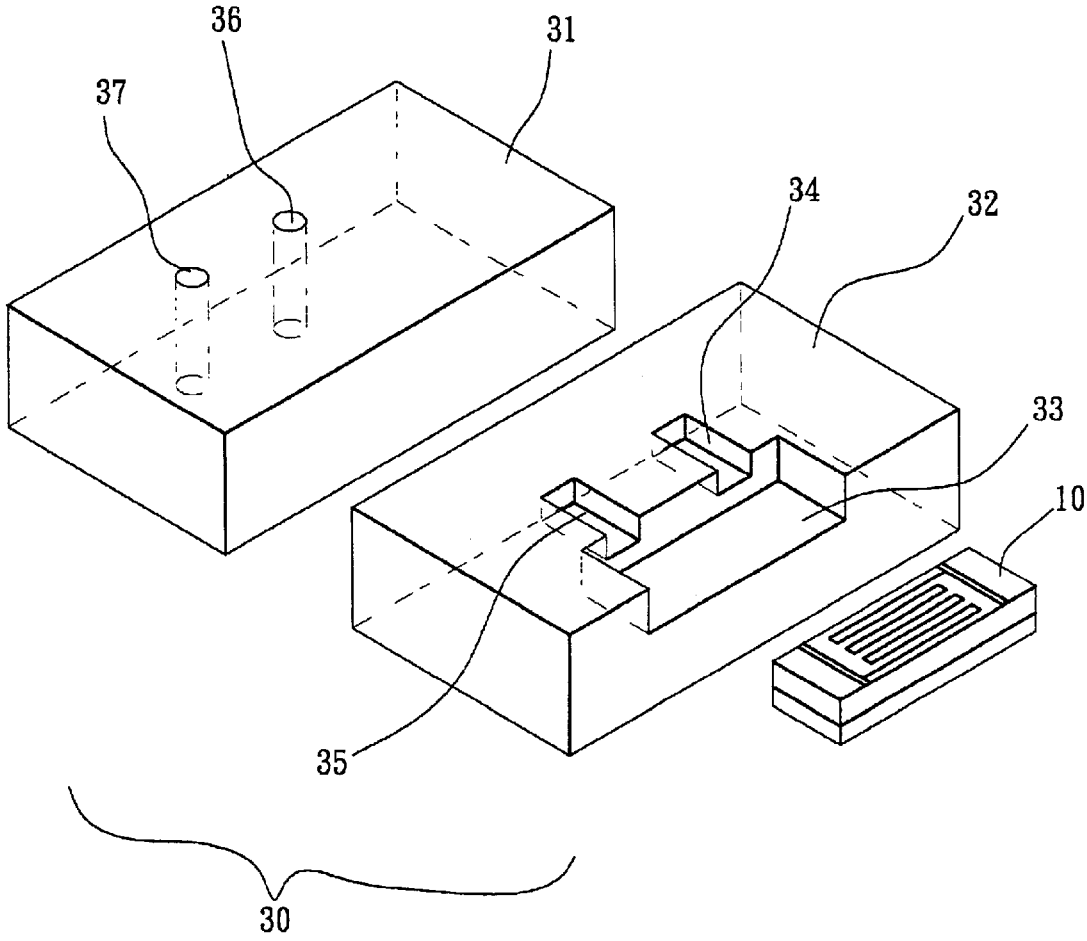
FIG. 3 shows the structure of an interface device suited in the microfluid driving device of this invention.

In order to connect the pneumatic flow supply and control module 20 and the microfluid driving platform 10, an interface device 30 is prepared. FIG. 3 shows the structure of the interface device 30. As shown in this figure, the interface device has an upper cover 31 and a substrate 32. In the substrate 32 provided is a seat 33 for the microfluid driving platform 10. At the seat 33, two airflow guides 34 and 35 are provided at positions corresponding to inlets of the Venturi pumps 12, 13 of the microfluid driving platform 10, when the microfluid driving platform 10 is positioned inside the seat 33. In the upper cover 31, two airflow inlets 36, 37 are provided at positions corresponding to the two airflow guides 34, 35, respectively. Connectors (not shown) of the airflow supplying pipes 22, 23 of the pneumatic flow supply and control module 20 may be plugged to the airflow inlets 36, 37. Sealing the upper cover 31 and the substrate 32, the interface device 30 is thus accomplished. In using the interface device 30, connectors of the airflow supplying pipes 22, 24 are plugged into the airflow inlets 36, 37 and the microfluid driving platform 10 is placed into the seat 33 of the interface device 30. The fluid in the microchannel 11 can thus be driven to move forward, backward or halt.

Figure 4:
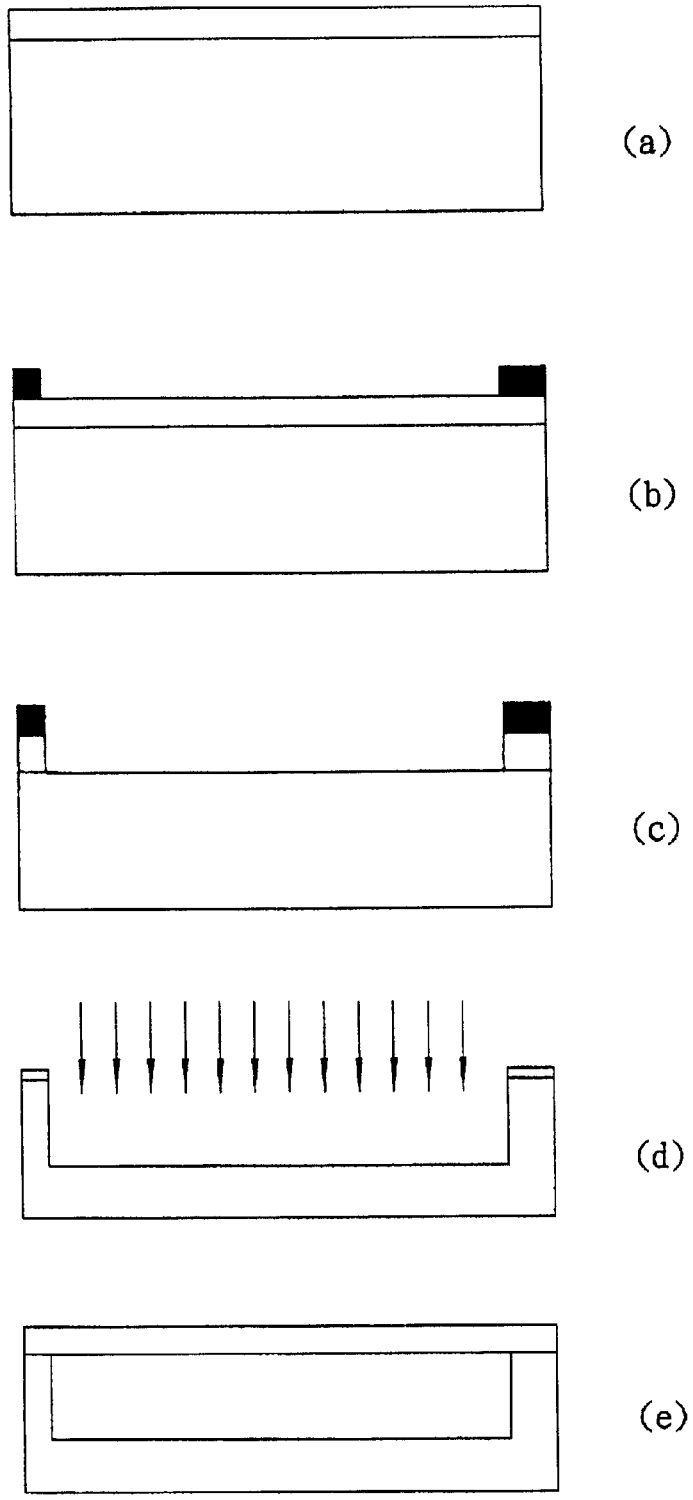
FIG. 4 shows the flow chart of the preparation of a microfluid driving platform suited the microfluid driving device of this invention.

The microfluid driving platform 10 may be fabricated with the microfabrication technology. FIG. 4 shows the flow chart of the preparation of the microfluid driving platform 10. As shown in this figure, at step (a), a silicon chip is first processed in a furnace to grow a thermal oxide layer to function as a mask for further deep etching. At step (b), the lithographic process is applied and at step (c), the oxide etching process is applied to form the pattern of the microchannel. At step (d), the substrate is deep etched to a desired depth with the ICP (inductively coupled plasma) technology. At step (e), the substrate is anodic bonded with a pyrex glass wafer and diced into a desired size.

In the preparation of low-cost, disposable microfluid driving chips, the microfluid driving platform may be prepared with polymer materials such as PMMA and the microchannel may be prepared with the ICP or UV LIGA (a term combining the lithography, electroplating and molding) process. Either the above-said silicon deep etching structure or a thick photoresist structure may be used to prepare the substrate PMMA structure after the electroplating and hot embossing process. The cover glass wafer may be adhered to the PMMA substrate with adhesives.

EXAMPLE

A chip having a microchannel and two Venturi pumps connected to both terminals of the microchannel is prepared. The specification of the device is:

Size of chip: 30 mm(L)*15 mm(W)*525 μm(H).

Venturi pump: Airflow inlet sized 2 mm(W)*300 μg m(D). After 3 mm from the inlet an inward declination of 25° is formed until size of the channel to be 1.0 mm(L)*1.0 mm(W)*300 μm(D). Then an outward declination of 10° is formed until size of the channel to be 2 mm(W)*300 μg m(D) as outlet. Opening at connection of the Venturi pump and the microchannel is sized 300 m(W)*300 μm(D).

Microchannel: 300 μm(W)*300 μm(D)*15 cm (L).

Testing fluid: Blue ink, about 4.3 μl.

A silicon-glass plate of 30 mm(L)*15 mm(W)*1.0 mm(T) is prepared. An inlet is prepared at the upper Venturi pump. The testing fluid is filled into the inlet and is introduced into the microchannel by the surface tension of the fluid, until the force is balanced. Supply airflow to the bottom Venturi pump to generate the Bernoullis effect to suck the testing fluid into the microchannel until the testing fluid is at a desired position. Then supply airflow to the upper Venturi pump to generate sucking force until both sucking forces come to a balance and the movement of the testing fluid stops. When the sucking force of the upper Venturi pump is greater than that of the bottom pump, the testing fluid moves towards the upper Venturi pump. With an electromagnetic valve to control the airflow supply to both Venturi pumps, the testing fluid may move forward and backward in the microchannel. When the flow rate and the timing of the airflow supply is controlled, the testing fluid may be driven to move forward and backward in the microchannel at selected speeds and frequencies.

Experiments show that when the flow rate of the supplied airflow is 2.7 slpm (standard liter per minute), movement of the 4.3 μl blue ink is at the speed of 9.5 mm/sec., which is approximately equal to 0.86 μl/sec by volumetric pumping speed. Increasing the flow rate may obtain higher flow speed of the microfluid.

FIG. 5 is a table showing the relation between the flow rates of the driving airflow and the flow rates of microfluid as driven. As shown in this table, the flow rate of the testing fluid increases along with the increase of the flow rate of the supplied airflow. The flow rate of the testing fluid may be easily controlled by airflow supply to the Venturi pump at selected flow rates.

EFFECTS OF INVENTION

The pneumatic servo system used in this invention has a simplified structure and is easy to operate. The manufacture cost of the invented pneumatic servo system is lower than that of the traditional mechanical micropumps, the electrode driving micropumps or any other driving systems with external servo devices. In the microfluid driving system of this invention it is easy to accomplish the bi-directional driving of the microfluid. Potential applications may be found in the application of multiple pump systems.

In the present invention there is no need to provide complicated connection between the pneumatic flow supply and control module and the microfluid driving platform. The problem of the system-to-chip coupler is thus solved.

Under any operation mold, all supplied airflows are supplied to the microfluid driving module and exhausted to the environment. There is no direct connection between the supplied airflow and the micro reaction module. As a result, the pneumatic servo system will not be polluted by the samples or biochemical reagents carried by the micro reaction module.

At the micro reaction module no moveable components are needed. The structure of the invented device is obviously simpler than that of mechanical micropumps, wherein active valves or passive valves are used. In this invention, the flow rate of the microfluid is irrelevant to the polarity or the concentration of the driven fluid. This invention provides a wider scope of application.

As the present invention has been shown and described with reference to preferred embodiments thereof, those skilled in the art will recognize that the above and other changes may be made therein without departing from the spirit and scope of the invention.

What is claimed is:

1. A microfluid driving device for bi-directional movement control, comprising:

a substrate;

a microchannel formed in said substrate to allow a fluid to flow inside said microchannel;

a first Venturi pump connected to said microchannel to generate a pumping force in a first direction to said fluid in said microchannel, when an airflow is applied to said first Venturi pump;

a second Venturi pump connected to said microchannel to generate a pumping force in a second direction to said fluid in said microchannel, when an airflow is applied to said second Venturi pump; and an airflow supply connected to said first and second Venturi pumps to supply airflows to said first Venturi pump, said second Venturi pump, and both said first and second Venturi pumps.

2. The microfluid driving device according to claim 1, further comprising an airflow control component to control the supply of airflows to said first and second Venturi pumps and the flow rate of said supplied airflows.

3. The microfluid driving device according to claim 1 or 2, wherein a fluid inlet is provided at a downstream position of the airflow channel of said first Venturi pump.

4. The microfluid driving device according to claim 1 or 2, further comprising at least one micro mixer, micro reactor, micro sensor, or combination thereof, in said microchannel.

* * * * *